US005875658A

United States Patent [19]

Lahtinen et al.

[11] Patent Number: 5,875,658

[45] Date of Patent: Mar. 2, 1999

[54] LOCKING MECHANISM FOR GATES AND HATCHES

[76] Inventors: Mauno Urpo Olavi Lahtinen, Mukkulankatu 4 B 17; Paavo Juhani Holtta, Kivakatu 1 A 4, both of FIN-15210 lAHTI, Finland

[21] Appl. No.: 836,385

[22] PCT Filed: Nov. 8, 1995

[86] PCT No.: PCT/FI95/00680

§ 371 Date: Sep. 25, 1997

§ 102(e) Date: Sep. 25, 1997

[87] PCT Pub. No.: WO96/15023

PCT Pub. Date: May 23, 1996

[30] Foreign Application Priority Data

Nov. 9, 1994 [FI] Finland ..... 945261

[51] Int. Cl.[6] ..... E05B 67/36

[52] U.S. Cl. ..... 70/34; 292/302; 70/104

[58] Field of Search ..... 70/33, 34, 104; 292/302, 327

[56] References Cited

U.S. PATENT DOCUMENTS

| | | | |
|---|---|---|---|
| 652,462 | 6/1900 | Kessler . | |
| 1,192,733 | 7/1916 | Bennett | 292/302 X |
| 1,967,627 | 7/1934 | Riley et al. | 292/302 X |
| 2,100,591 | 11/1937 | Haberstump | 292/302 |
| 2,127,992 | 8/1938 | Carter | 292/302 |
| 2,284,180 | 5/1942 | Thomas | 292/302 X |
| 2,394,749 | 2/1946 | Chester | 292/302 X |
| 3,951,443 | 4/1976 | Barnaby | 292/327 |
| 4,013,311 | 3/1977 | Prezioso | 292/327 |
| 5,255,542 | 10/1993 | Fortin | 70/104 X |
| 5,544,506 | 8/1996 | Nakano | 70/104 X |

FOREIGN PATENT DOCUMENTS

| | | |
|---|---|---|
| 45494 | 8/1928 | Finland . |
| 49937 | 1/1971 | Finland . |
| 75771 | 4/1988 | Finland . |
| 89905 | 8/1957 | Norway . |
| 108525 | 4/1966 | Norway . |
| 417935 | 4/1981 | Sweden . |

*Primary Examiner*—Suzanne Dino Barrett
*Attorney, Agent, or Firm*—Banner & Witcoff, Ltd.

[57] ABSTRACT

A locking mechanism for large gates and hatches, such as visor, deck, bow and stem gates located on the side of a vessel. The locking mechanism includes an elongated hard-surface guide part having a hard-surface guide slot. The locking mechanism also includes one or more elongated hard-surface locking parts for securing within the guide slot. The elongated locking parts can include parts of unequal dimensions that simultaneously move in order to center themselves inside the hard-surface guide part. The locking part and the guide part each include two long sides that are beveled in a similar manner for forming a tight fit between the two parts when locked together. At least one locking pin passing through a respective slot in each of the parts tightly locks the two parts together to form a rigid construction in every direction. The construction can be unlocked and dismantled by undoing the locking pin or pins. Unlocking can also be facilitated by means of an opener pin.

3 Claims, 1 Drawing Sheet

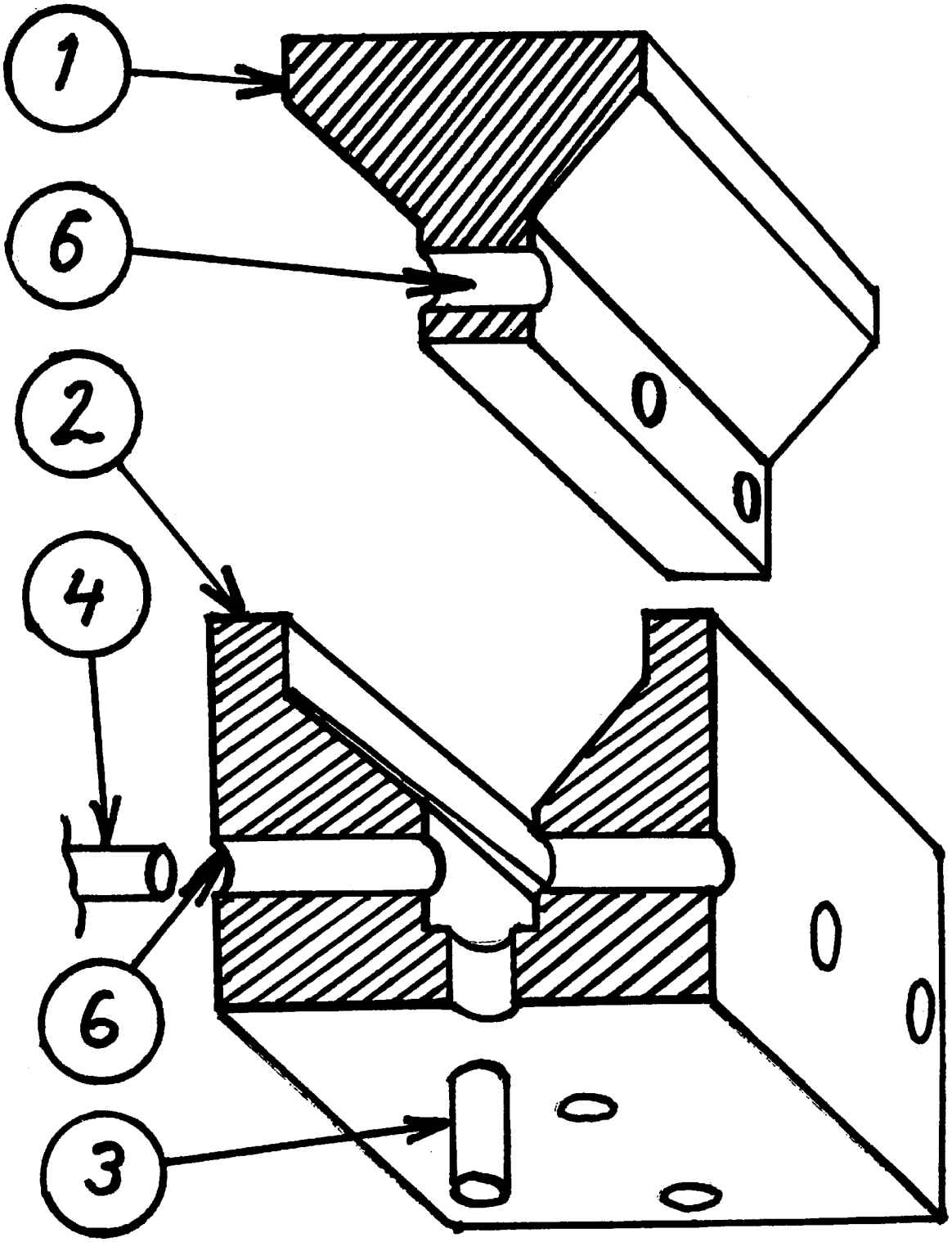
1
6
2
4
6
3

LOCKING MECHANISM FOR GATES AND HATCHES

FIELD OF THE INVENTION

The present invention relates to a locking mechanism for large gates and hatches, such as visors, deck, bow and stern gates located on the side of vessels, and more particularly to a locking mechanism having elongated parts that are tightly fitted to each other and secured in this tight fitting relationship by a locking pin.

BACKGROUND OF THE INVENTION

Numerous factors can be the source of difficulty for a worker attempting to lock or unlock large gates and hatches located on the side, deck, bow or stern of a vessel. These factors include the deformation of the gates or hatches, the effects of applied external stresses and impacts and the freezing of the locks that secure the gates or hatches closed. Any one of these factors or a combination thereof can make it difficult for a worker to properly operate the locks and thus the gates and hatches. The tightening of closed gates constitutes a further problem because the gates are generally large in size and difficult to settle in a correct position. These gates are usually fitted with various kinds of hook mechanisms tightened with screws. Tightening can also be accomplished hydraulically, or by using other forced measures and levers to add to the force. Problems also exist with conventional locking mechanisms because they are unable to withstand the forces applied to them when the gates are guided into their properly closed position.

SUMMARY OF THE INVENTION

The present invention relates to a locking mechanism for large gates and hatches, such as visor, deck, bow and stern gates located on the side of a vessel. The locking mechanism according to the present invention assists in eliminating problems arising from the deformation of large gates and from the stresses to which they are subjected. The present invention also diminishes the stresses and number of lock system sealing devices needed to secure the gates or hatches. The present invention includes an elongated guide slot part and an elongated locking part for securing within the guide slot part. The locking part and the guide slot part each include two long sides that are beveled in a similar manner for forming a tight fit between the two parts when they are locked together. At least one locking pin is passed through a respective slot in each of the parts to lock the two parts together. The locking mechanism according to the present invention makes it easier to guide the gates or hatches into their intended position. The locking mechanism also makes locking of the gates or hatches more secure as a result of gates or hatches being properly positioned. Moreover, the locking mechanism reduces the amount of force needed to initially open a gate or hatch.

BRIEF DESCRIPTION OF THE FIGURE

The FIGURE is an exploded view of the locking mechanism according to the present invention with the locking part and guide slot part being shown partially in cross-section.

DETAILED DESCRIPTION OF THE PRESENT INVENTION

The present invention relates to a locking mechanism for large gates and hatches, such as visor, deck, bow and stern gates located on the side of a vessel. The present invention includes one or more hard-surface locking arm parts 1 having beveled sides. The locking arm part(s) 1 can be of unequal length or of the same dimension as the gates or hatches. The locking mechanism also includes a hard-surface guide slot part 2 having beveled inner sides for receiving the locking part(s) 1. As can be seen in the FIGURE, the beveled sides of locking part 1 and guide slot part 2 extend parallel to the longitudinal axis of each part 1, 2. When the locking part(s) 1 are inserted within the guide slot part 2, part(s) 1 simultaneously self-center themselves within the groove formed by the beveled sidewalls of the guide slot part 2. Parts 1 and 2 form a tight fit with each other and may feature individual sealing surfaces. Each elongated locking part 1 may be pin, cone or wedge shaped, a long profiled piece or a combination of all of these that is capable of fitting within the slot in part 2.

The elongated locking arm part 1 and the elongated guide slot part 2 each include a pin slot extending perpendicular to the longitudinal axis of parts 1 and 2 for receiving a locking pin or part 4. Locking pin 4 may consist of a pin, wedge, cone, slotted bar or shoulder. Pin 4 locks parts 1 and 2 together. When pin 4 is inserted in a slot in part 1 and the slot in the shoulders 6 of part 2, elongated parts 1 and 2 are tightened together into a rigid construction. Parts 1 and 2 are unlocked from each other by an opening device part 3, of which there may be more than one. Pin 4 must at least be removed from one shoulder 6 of part 2 and all of part 1 for the mechanism to unlock.

Parts 1 and 2 may be located alternatively in hatches or in gates or in the frame of the vessel. Depending on the application, more than one locking and unlocking mechanism may be used for one gate or hatch. From the foregoing detailed description it will be evident that the present invention may include a number of different locking systems such as one or several locking and unlocking systems of unequal length or of the same dimension as the gates or hatches without departing from the spirt or scope of the invention which is defined by the appended claims.

We claim:

1. A locking mechanism for large gates and hatches, such as visors, deck, bow and stem gates located on the sides of vessels, said locking mechanism comprising:

A) an elongated guide slot part including a guide slot having a longitudinal axis, said elongated guide slot part also including two beveled sides and at least one pin slot, said pin slot extending at an angle to said longitudinal axis;

B) an elongated locking part for inserting within said elongated guide slot part, said elongated locking part having a longitudinal axis and two beveled sides, said elongated locking part having at least one pin slot extending at an angle to said longitudinal axis of said elongated locking part;

C) at least one locking pin for passing through said at least one pin slot in said elongated guide slot part and said at least one pin slot in said elongated locking part; and D) wherein said beveled sides of said elongated locking part form a tight fit with said beveled sides of said elongated guide slot part when said at least one locking pin is inserted through said at least one pin slot in said elongated guide slot and said at least one pin slot in said elongated locking part.

2. The locking mechanism according to claim 1, wherein said at least one locking pin is cone-shaped.

3. The locking mechanism according to claim 1, wherein the mechanism further comprises an unlocking pin arranged in said elongated guide slot part.

* * * * *